United States Patent [19]

Mednis

[11] Patent Number: 4,673,094

[45] Date of Patent: Jun. 16, 1987

[54] LARGE STUB SPOUT BOTTLES AND MATED COMBINATION UNIT

[75] Inventor: Juris M. Mednis, Howell, N.J.

[73] Assignee: Universal Symetrics Corporation, Howell, N.J.

[21] Appl. No.: 910,366

[22] Filed: Sep. 22, 1986

[51] Int. Cl.[4] ..... B65D 21/02

[52] U.S. Cl. ..... 215/10; D9/370; D9/375; 206/504; 206/509; 215/1 C; 222/143

[58] Field of Search ..... 206/503, 504, 508, 509; 220/23.4, 23.83, 23.86, DIG. 13; 222/143; D9/370, 373, 375, 376, 3; 215/10, 1 C

[56] References Cited

U.S. PATENT DOCUMENTS

| | | | |
|---|---|---|---|
| D. 261,360 | 10/1981 | Epperson | D9/375 |
| D. 267,701 | 1/1983 | Pardo | D9/375 |
| D. 284,742 | 7/1986 | Murakurthy | D9/375 |
| 3,481,841 | 5/1983 | Schwatz | 215/10 |
| 3,750,890 | 8/1983 | Smith | 220/23.4 |
| 4,489,839 | 12/1984 | Epperson | 215/10 |
| 4,570,799 | 2/1986 | Mednis | 215/10 |
| 4,573,595 | 3/1986 | Mednis | 215/10 |

*Primary Examiner*—George E. Lowrance
*Attorney, Agent, or Firm*—Angelo Notaro

[57] ABSTRACT

A mateable bottle having a hollow L-shaped body is disclosed which has a neck portion formed as a neck rib in an inner front wall surface of the body. The neck terminates in a stub spout which has a large diameter opening, opening into the interior of the hollow body. A concave recess, provided in an outer front wall surface, is shaped to receive a neck rib of a mated container. Outer surfaces of two mated bottles are provided with planar and perpendicular surfaces so that a rectangular solid is formed when the two bottles are mated to each other.

11 Claims, 5 Drawing Figures

LARGE STUB SPOUT BOTTLES AND MATED COMBINATION UNIT

CROSS-REFERENCE TO RELATED APPLICATION

This application is related to U.S. design application Ser. No. 847,837 filed Apr. 3, 1986.

BACKGROUND OF THE INVENTION

The present invention relates in general to bottles, and more particularly, to a new and useful mated bottle unit in which the bottles in the unit are provided with large diameter stub spouts.

A mated container unit is disclosed in U.S. Pat. No. 4,573,595. The unit is composed of a pair of containers or bottles that have a substantially elongated neck, each being insertable into a recess of the other container or bottle. The mated containers form a polyhedron substantially filling and occupying no more than the minimum rectangular polyhedron needed to encompass a single one of the containers. In this way, a compact rectangular solid structure can be formed. A multiple container package, which again utilizes elongated necks that fit into recesses of adjacent containers, is disclosed by U.S. Pat. No. 4,570,799. Again, the combined polyhedral unit, which is formed, is substantially filled.

Short neck stackable containers engageable with each other are disclosed in U.S. Pat. No. 4,489,839 and U.S. Pat. No. 3,391,824. Such containers do not provide the substantial oenefits of full space utilization.

All of the foregoing containers include necks that have relatively small diameter discharge openings. The diameter of the discharge opening is primarily limited by the requirement that the neck fit into the recess of a receiving container.

It is often necessary, however, to provide containers with large diameter openings, e.g. where fluids of solids having poor flowing characteristics must be stored. It is advantageous in such cases to make the opening large enough so that the contents of the container can easily be scooped out through the opening. Particularly describable would be a short neck or stub spout mateable bottle arrangement which does not require an increase in the head room that is required for a single unit.

SUMMARY OF THE INVENTION

The present invention is directed to a bottle that has a large diameter stub spout and which is shaped so that it can be mated and interengaged with another similarly shaped bottle to form a substantially rectangular solid structure that is both attractive and functional. The rectangular shape of the mated bottles make them easy and convenient to store and also maximizes the use of required storage space.

Each bottle has a generally L-shaped body. In accordance with the preferred embodiments of the invention, the bottles of the invention are provided with generally L-shaped sides, each having a vertically extending portion and a horizontally extending portion. A lower top shoulder is formed atop the horizontally extending portion and an upper top shoulder if formed atop the vertically extending portion. The lower and upper top shoulder are joined by a vertically extending inner front wall which includes a convex neck projection that forms the base of the neck of the bottle. The neck area terminates above the surface of the upper top shoulder in a stub spout having a circular opening of relatively large diameter. The diameter of the opening is greater than the length of the stub spout.

The outer front wall of the L-shaped body has a concave recess which conforms in shape to the neck projection of another bottle so that two similar bottles, one inverted relative to the other, can be mated together, the neck projections of each bottle being seated in the concave recess of the other bottle.

The length of the recess in each bottle must be at least as long as the combined lengths of the neck projection and the stub spout of the other bottle so that when the bottles are mated a substantially rectangular solid shape results having an overall height of a single bottle inclusive of its cap.

BRIEF DESCRIPTION OF THE DRAWINGS

In the accompanying drawings, forming a part of this specification, and in which reference numerals shown in the drawings designate like or corresponding parts throughout the same.

DESCRIPTION OF THE PREFERRED EMBODIMENTS

Figure 1:
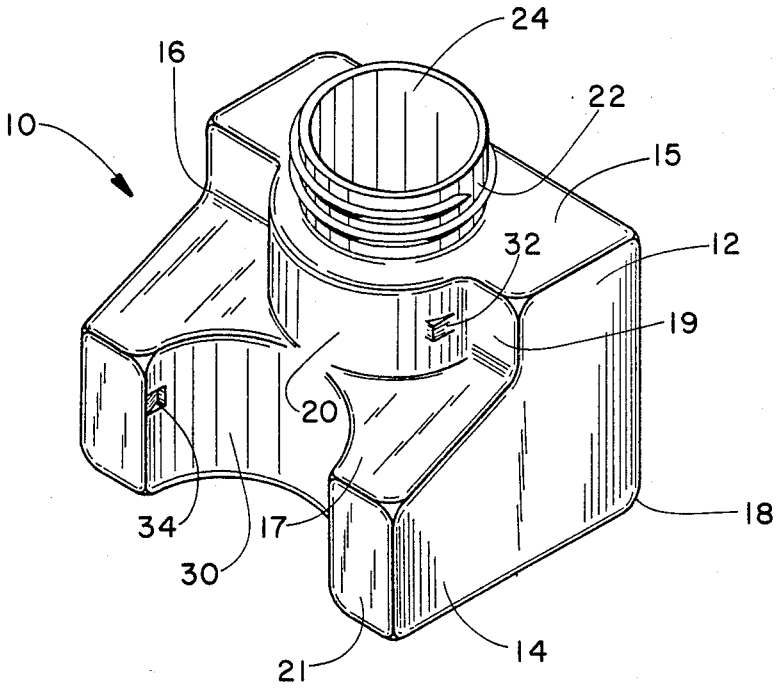
FIG. 1 is a top perspective view of a bottle in accordance with the present invention.
Figure 2:
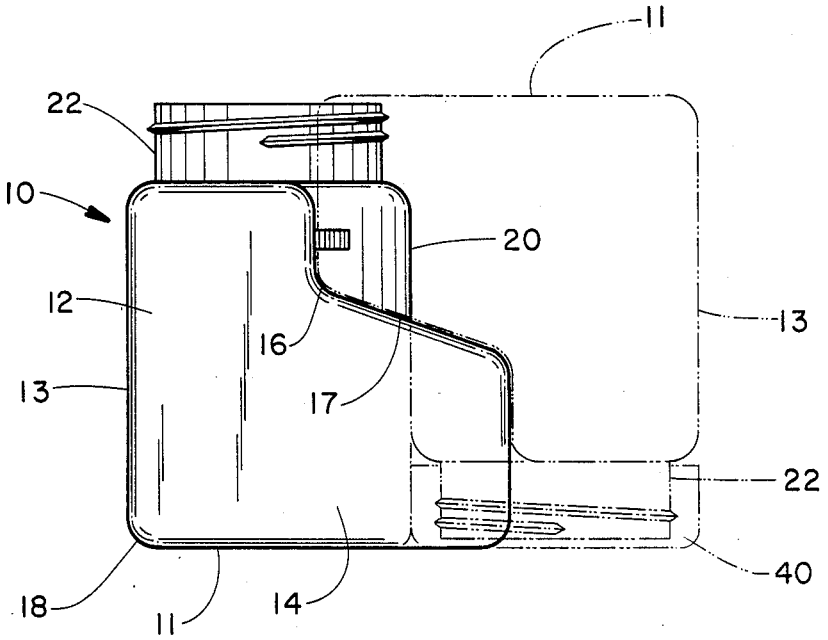
FIG. 2 is a side elevational view of the bottle of FIG. 1 with another identical bottle, shown in dotted lines, mated with the bottle of FIG. 1 to form a substantially rectangular solid shape.

Referring to FIGS. 1 and 2, a bottle, according to the first embodiment of the invention, comprises a hollow L-shaped body, generally designated 10, that has L-shaped side walls, each having a vertically extending portion 12 and a horizontally extending portion 14. The vertical and horizontal portions 12, 14 are connected to each other to form an inner corner edge 16 and an outer corner edge 18 which are parallel to each other and which extend from side wall to side wall.

As shown in FIG. 2, a horizontal bottom wall 11 and a vertical rear wall 13 are joined along the outer corner edge 18. An upper top shoulder 15 is located atop the vertically extending portion 12 and a lower top shoulder 17 is located atop the horizontally extending portion 14. The upper top shoulder 15 and the lower top shoulder 17 are joined by a vertically extending inner front wall 19 which is connected to the lower top shoulder 17 along the inner corner edge 16. An outer front wall 21 extends between the lower top shoulder 17 and the bottom wall 11. A hollow neck, made in one piece with the L-shaped body, is formed of a convex neck rib 20 which projects outwardly toward the front of the bottle from the inner front wall 19 and which extends upwardly, from the lower top shoulder 17. The neck portion has a short neck extension or stub spout 22 which extends upwardly from the surface of the upper top shoulder 15 and which has a large diameter opening 24 which opens into the interior of the hollow L-shaped body 10.

In order to preserve a substantially rectangular solid shape when a bottle, as shown in FIG. 1, is mated with an identical or similar bottle, the stub spout 22 has a length which is dimensioned to be shorter than the diameter of opening 24 of the stub spout. As used herein, the terms "stub spout", "large diameter spout" or "large diameter opening" mean that the ratio between the diameter of opening 24 and the length of stub spout 22 is about 2:1 or more.

Functionally, the neck is very strong due to its short extension in length beyond the surface of the upper top shoulder 15 and the fact that its neck rib 22 is fully supported on both sides and at its base by surfaces of the lower top shoulder 17 and inner front wall 19. In the mated condition shown in FIG. 2, the neck is even partly protected by the enveloping horizontal portion 14.

In FIG. 2, an identical bottle to that shown in FIG. 1, as shown by dotted lines, is inverted and mated with the bottle of FIG. 1. The neck rib 20 of the inverted bottle is seated in the concave recess 30 of the upright bottle and the neck rib 20 of the upright bottle is seated in a corresponding concave recess of the inverted bottle.

The inverted bottle is shown with a cap 40. The length and outside diameter of stub spout 22 are selected so that, with a cap attached, the neck and cap substantially fills the recess 30 of a mated unit and the top of the cap comes flush with the surface of the bottom wall 11.

The concave recess 30 is formed in the outer front wall surface 21 of the horizontal portion 14, as shown in FIG. 1, and has a cross-sectional shape which corresponds to the cross-sectional shape of neck rib 20, viewed in a plan view, parallel to the bottom wall 11. Recess 30 extends from the bottom wall 11 to the lower top shoulder 17, by a length which is equal to the combined length of neck rib 20 plus the stub spout 22.

While identical bottles are shown mated in FIG. 2, it is understood that bottles having different neck and recess lengths can be mated as long as the length of the recess matches the length of the neck including the rib and stub spout.

In the embodiment of FIGS. 1 and 2, the neck rib 20 and recess 30 have a cylindrical shape. The remaining surfaces of the horizontal and vertical portions 12, 14 are planar and the rear wall 13 and bottom wall 11 are perpendicular to each other to form a substantially rectangular solid shape when two such bottles are mated. The lower top shoulder 17 is inclined.

Figure 3:
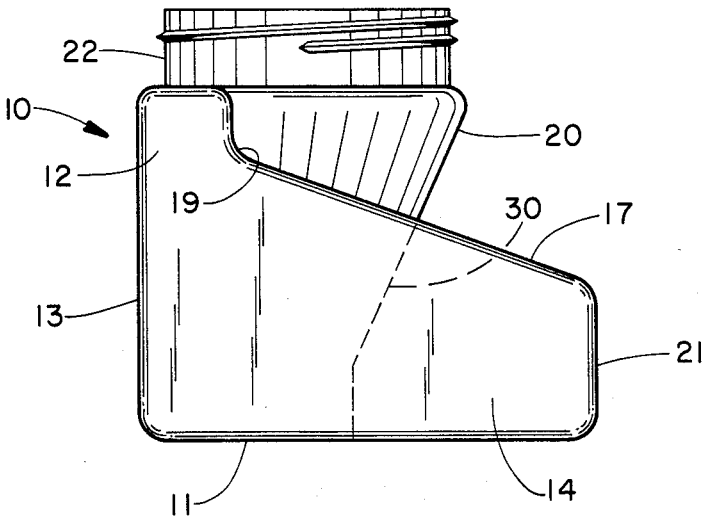
FIG. 3 is a side elevational view of another embodiment of the bottle according to the invention.

In the embodiment of FIG. 3, the neck rib 20 and recess 30 are in the form of truncated cones. The cross-sections of the rib and recess match so that a neck of one bottle can mate with a recess of another bottle. The cone slopes toward the rear wall from the top to the bottom of the bottle.

Figure 4:
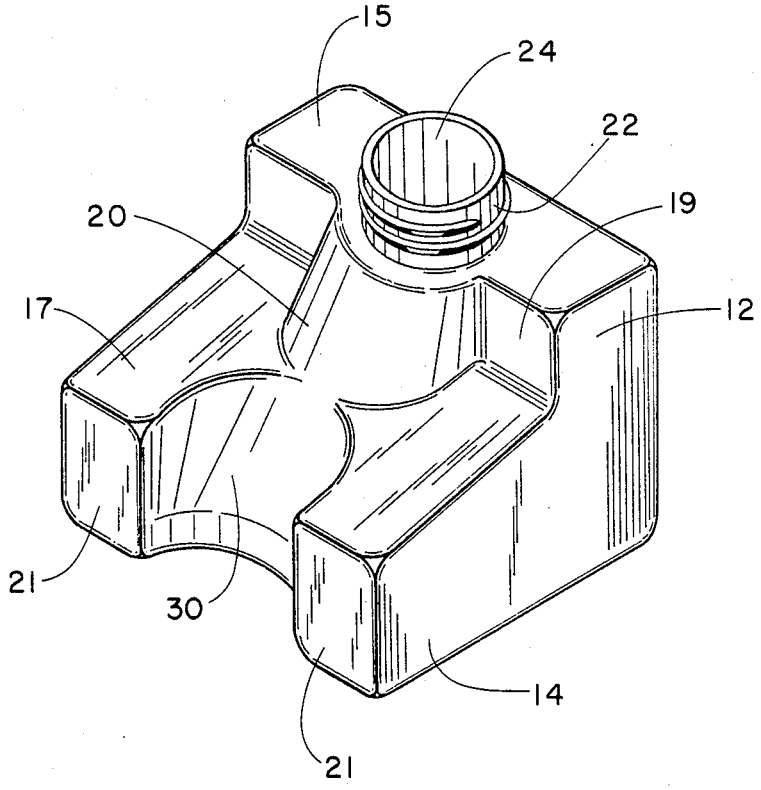
FIG. 4 is top perspective view of a still further embodiment of a bottle according to the invention.

In the embodiment of FIG. 4, the neck rib 20 and recess 30 are again in the form of a truncated cone but, in this embodiment, the neck rib slopes outwardly toward the front wall, from the top to the bottom of the bottle.

Figure 5:
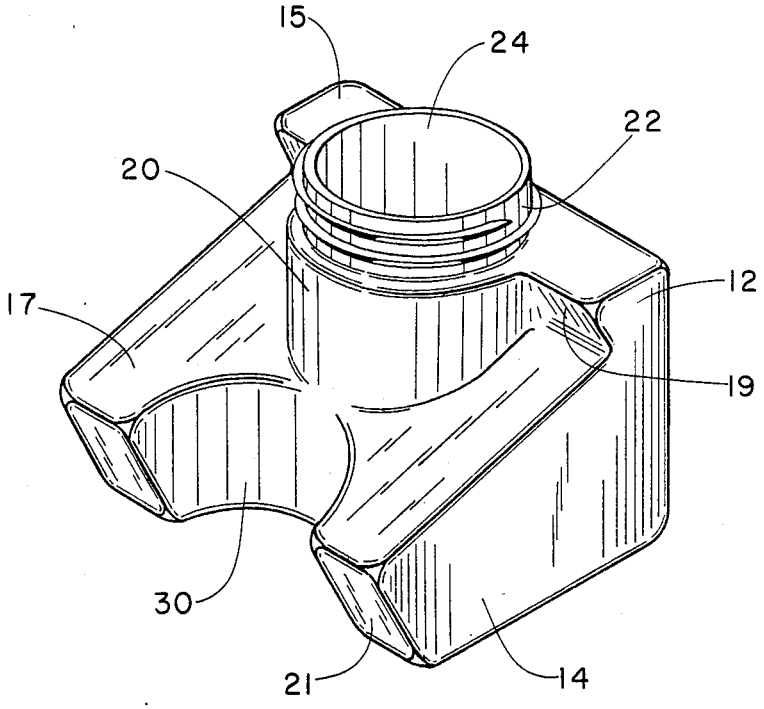
FIG. 5 is a top perspective view of even still another embodiment of a bottle according to the invention.

In the embodiment of FIG. 5, a right cylindrical neck rib 20 and recess 30 are provided. The surfaces of the inner and outer front walls 19, 17 are inclined at an angle with respect to the rib and recess 20, 30 and the rear wall 12. As long as the surfaces of the inner front wall 19 and outer front wall 21 match, however, a rectangular solid will be formed when two such bottles are mated.

In order to more positively secure the mated containers together, as shown in the embodiments of FIGS. 1 and 2, a pair of projections 32 are included on the sides of the neck rib 20 which can engage in a pair of detents 34 provided at the sides of the recess 30. The detents have diverging sides in a direction into the recess 30 and the projections 32 have converging sides in the direction toward the inner front wall 19 so that a resilient snap connection is established between two similar bottles when they are mated together.

The material of the bottles are preferably plastic and selected from suitable composition well known in the art but may also be made of any other, preferably resilient materials.

The bottles may also be made of more rigid materials if the projections and detents 32, 34 are omitted.

The invention claimed is:

1. A bottle comprising a hollow, L-shaped body having a vertically extended portion and a horizontally extended portion connected to each other to form an inner corner edge and an outer corner edge, generally L-shaped side walls, a rear wall and bottom wall connected to the rear wall along the outer corner edge, a lower top shoulder atop the horizontally extended portion and an upper top shoulder atop the vertically extended portion, a vertically extended inner front wall connected between the upper top shoulder and lower top shoulder and connected along the inner corner edge to the lower top shoulder, an outer front wall connected between the lower top shoulder and bottom wall and between the side walls, and a hollow neck portion made in one piece with said L-shaped body, said neck portion comprising a convex neck rib projecting from the inner front wall and extending from the lower top surface to the upper top surface, said neck portion having a discharge opening, the outer front wall having a concave recess, the concave recess and the neck rib having complimentary cross-sectional shapes taken in a plane which is parallel to bottom wall, said recess extending from the lower top shoulder toward the bottom wall and having a length selected so as to receive the neck portion of another bottle.

2. A bottle according to claim 1, wherein the neck portion includes a stub spout extending above the upper top shoulder, said discharge opening having a circular crosssection, and the stub spout having a length which is smaller than a diameter of said discharge opening.

3. A bottle according to claim 2, wherein the top shoulder has a surface parallel to the bottom wall and outer front wall has a surface parallel to the rear wall.

4. A bottle according to claim 3, wherein the upper top shoulder and the rear wall are perpendicular to each other and the outer front surface and bottom wall are perpendicular to each other.

5. A bottle according to claim 4, wherein said neck rib and concave recess are cylindrical.

6. A bottle according to claim 4, wherein said neck rib and recess have truncated conical shapes.

7. A bottle according to claim 6, wherein said truncated conical shapes of said neck rib and said recess slopes toward the rear wall from the top of the bottom of the bottle.

8. A bottle according to claim 6, wherein said truncated conical shapes of said neck rib and recess slopes toward the outer front wall from the top to the bottom of the bottle.

9. A bottle according to claim 3, wherein the inner front wall and the outer front wall extend parallel to each other and at an acute angle relative to the bottom wall.

10. A bottle according to claim 1, wherein said neck rib includes a pair of side projections thereon adjacent the inner front wall and said concave recess has a pair of detents on sides thereof adjacent the outer front wall which are positioned to receive the projections of another bottle.

11. A bottle according to claim 2, wherein said discharge opening has a diameter of at least twice the length of said stub spout.

* * * * *